US007178474B2

(12) United States Patent
Warnes

(10) Patent No.: US 7,178,474 B2
(45) Date of Patent: Feb. 20, 2007

(54) BALLAST SYSTEM FOR BOATS

(76) Inventor: Daniel Warnes, 345 Albers Road, Lumby, British Columbia (CA) V0E 2G5

( * ) Notice: Subject to any disclaimer, the term of this patent is extended or adjusted under 35 U.S.C. 154(b) by 56 days.

(21) Appl. No.: 11/165,291

(22) Filed: Jun. 24, 2005

(65) Prior Publication Data

US 2005/0284353 A1 Dec. 29, 2005

Related U.S. Application Data

(60) Provisional application No. 60/582,068, filed on Jun. 24, 2004.

(51) Int. Cl.
*B63B 39/00* (2006.01)
*B63B 39/03* (2006.01)

(52) U.S. Cl. ..... 114/125; 114/121

(58) Field of Classification Search ..... 114/121, 114/125, 74 R; 220/564, 495.07
See application file for complete search history.

(56) References Cited

U.S. PATENT DOCUMENTS

| | | | | |
|---|---|---|---|---|
| 860,492 | A | 7/1907 | Mehrtens | |
| 2,077,143 | A | 4/1937 | Carroll | |
| 3,356,251 | A * | 12/1967 | Roberts | 220/495.07 |
| 3,503,358 | A | 3/1970 | Moesly | |
| 3,707,937 | A | 1/1973 | Liles | |
| 4,030,438 | A | 6/1977 | Telfer | |
| 4,117,796 | A | 10/1978 | Strain | |
| 4,217,845 | A | 8/1980 | Hood et al. | |
| 4,409,919 | A | 10/1983 | Strain | |
| 4,478,165 | A | 10/1984 | Strain | |
| 4,574,986 | A | 3/1986 | Baris et al. | |
| 4,800,832 | A | 1/1989 | Sulimierski | |
| 5,215,025 | A | 6/1993 | Talmor | |
| 5,325,804 | A | 7/1994 | Schneider | |
| 6,029,595 | A | 2/2000 | Bachmann | |
| 6,076,480 | A | 6/2000 | Chang, III et al. | |
| 2003/0183149 | A1 | 10/2003 | Jessen et al. | |
| 2005/0113234 | A1 | 5/2005 | Eagles et al. | |

FOREIGN PATENT DOCUMENTS

| | | |
|---|---|---|
| CA | 2442026 | 10/2002 |

* cited by examiner

*Primary Examiner*—Sherman Basinger
(74) *Attorney, Agent, or Firm*—Antony C. Edwards

(57) ABSTRACT

A hollow ballast tank contains within it a plurality of flexible bags for storing fluids such as fuel, freshwater and grey water. These fluids serve as functional ballast weight to complement the ballast weight provided by seawater which fills the remaining volume of the ballast tank upon being drawn into the tank through an intake pipe. Hoses run from each bag and emerge from a hatch in the upper surface of the ballast tank to service the boat. As fuel and freshwater are consumed, seawater is drawn into the ballast tank to compensate for the lost volume. Grey water may also be returned to a bag in the tank to serve as ballast weight.

13 Claims, 4 Drawing Sheets

BALLAST SYSTEM FOR BOATS

CROSS REFERENCE TO RELATED APPLICATION

This application claims priority from U.S. Provisional Patent Application No. 60/582,068 filed Jun. 24, 2004 entitled Ballast System for Boats.

FIELD OF THE INVENTION

The present invention relates in general to boats and more particularly to the field of ballast tanks within boats.

BACKGROUND OF THE INVENTION

In the prior art, applicant is aware of U.S. Pat. No. 5,215,025 which issued Jun. 1, 1993 to Talmor for a Boat, in which it is taught to provide collapsible fuel bags positioned within water ballast compartments so that, as fuel is consumed from the collapsible fuel bags, an increased amount of ballast water can be added to maintain the boat in its a ballasted condition. Further, applicant is aware of U.S. Pat. No. 5,325,804 which issued Jul. 5, 1994 to Schneider for a Fuel-Efficient Watercraft wherein a watercraft is claimed as including a self-compensating fuel tank which includes a fuel bladder disposed inside a rigid enclosure. A plurality of openings disposed in the rigid enclosure permit water to flow through the openings and include the enclosure as the water occupied by the fuel bladder decreases, or out of the enclosure as the volume occupied by the fuel bladder increases, whereby a total volume of fluid inside the rigid enclosure can remain substantially constant.

What is neither taught nor suggested, and which is one object of the present invention to provide, is the provision of additional bladders within the water ballast tank for providing, for example, fresh water supply and for providing a separate repository for grey water in part recapturing the fresh water once used by occupants of the vessel. It is a further object of the present invention to provide a plurality of flexible bladders which may be simply anchored within a water ballast container mounted in the hull of the vessel wherein the bladders may variously hold a gas such as air to assist in compressing, that is, slightly pressurizing, the contents of the remaining bladders which may include bladders having motor fuel and fresh water so as to assist in the dispensing of the fuel and water from those bladders.

SUMMARY OF THE INVENTION

In the present invention, a hollow ballast tank contains within it a plurality of flexible bags or bladders (herein collectively referred to as bags) for storing fluids such as fuel, freshwater and grey water. Grey water means water which has been soiled and is unfit for drinking. These fluids serve as functional ballast weight to complement the ballast weight provided by seawater which, as used herein, is intended to include any body of water whether fresh or saltwater in which the boat floats. The seawater fills the remaining volume of the ballast tank upon being drawn into the tank through an intake pipe. Hoses run from each bag and emerge from a hatch in the upper surface of the ballast tank to service the boat. As fuel and freshwater are consumed, seawater is drawn into the ballast tank to compensate for the lost volume. Grey water may also be returned to a bag in the tank to serve as ballast weight. Additionally, for use in boats which travel in very ecologically sensitive water bodes, or which travel near water bodes used extensively for swimming for example tourist resorts, an additional bag may be provided for holding black water, that is, sewage from the boat's head or other toilet.

The present invention includes a method and apparatus for maintaining a fluid ballast in the hull of a boat or other ship or vessel (collectively referred to herein as a boat), wherein the sea water ballast is contained within a tank or other container within or defined by the hull (collectively referred to herein as within the hull), and wherein the volume of seawater ballast is displaced by at least one, and preferably a plurality of flexible ballast bags which may be filled with useful fluids such as potable water in one ballast bag and motor fuel in a separate ballast bag. A further ballast bag may be provided in a preferred embodiment for retention of re-captured grey water. The ballast bags are maintained in fluid communication with accompanying means within the hull for extracting useful fluids from their corresponding ballast bags and returning re-captured grey water to its corresponding ballast bag so as to displace sea water from the sea water ballast, thereby providing a constant volume of liquid ballast including seawater, useful fluids and re-captured waste fluids. Pumping means being are provided to remove useful fluids from corresponding ballast bags for use in the boat, for example in the motor or by the crew. Means are also provided, which may be included within the pumping means, for filling the seawater ballast to compensate for the removal of useful fluid ballast so as to maintain the constant volume of ballast in the hull. A corresponding means is provided for displacing seawater from the seawater ballast by the operation of expansion of the waste fluid ballast bag or bags.

In summary, the present invention may be characterized in one aspect as including a container, which may be rigid or flexible, within the hull of a boat for holding seawater ballast wherein a plurality of flexible bags are mounted in the container so that the volume of the plurality of flexible bags displaces a like volume of seawater ballast from the container so as to maintain a substantially constant volume of fluid ballast in the container. The ballast bags are adapted for holding useful fluids including potable water in a first ballast bag, motor fuel in a second ballast bag and re-captured grey water in a third ballast bag. The flexible ballast bags may be mounted closely adjacent one another, nested within the container.

Pumping means extract useful fluids from the first and second ballast bags for use in the boat. Return means returns re-captured grey water re-captured from use in the boat to the corresponding third ballast bag. The ballast bags are in fluid communication with the pumping means and the return means. A means is provided for displacing from the container the like volume of sea water displaced by the ballast bags so as to displace seawater from the seawater ballast in the container to compensate for example for increasing volume of the grey water in the third ballast bag. A means is provided for filling the container with the seawater ballast to compensate for extracting of the useful fluids, thereby, again, providing a substantially constant volume of fluid ballast including the seawater, the useful fluids and the re-captured waste fluids.

In an alternative embodiment a gas-fillable bladder is provided, mounted in the container, in which case the pumping means may include a means for inflating the bladder with a gas such as air from a pressurized canister.

In one embodiment, when the flexible bags are substantially full, the container is more than one-half full of the fuel, the fresh water and the grey water if any. In the embodiment employing a gas-fillable bladder, when the bladder and the flexible ballast bags are substantially full, the container is substantially full of, respectively, the gas, the fuel, the fresh water, the grey water, if any.

The means for displacing the volume of seawater and the means for filling the container with the seawater may be a hollow conduit in fluid communication between the container and an exterior of the hull for free flow of seawater along the conduit into and out of the container.

The corresponding method according to one aspect of the present invention for maintaining a fluid ballast in the hull of a boat may include the steps of:

a) providing a container within the hull for holding seawater ballast, b) providing a plurality of flexible bags mounted in the container so that the volume of the plurality of flexible bags displaces a like volume of seawater ballast from the container so as to maintain a substantially constant volume of fluid ballast in the container, wherein the ballast bags are adapted for holding useful fluids including providing for holding potable water in a first ballast bag of the plurality of flexible bags, motor fuel in a second ballast bag of the plurality of flexible bags, and re-captured grey water in a third ballast bag of the plurality of flexible bags, c) providing pumping means for extracting the useful fluids from the first and second ballast bags for use in the boat, and return means for returning re-captured grey water re-captured from use in the boat to corresponding the third ballast bag, wherein the ballast bags are in fluid communication with the pumping means within the hull for extracting the useful fluids from corresponding the ballast bags and the return means for returning re-captured grey water to the corresponding the third ballast bag, d) providing a means for displacing the like volume of sea water from the container so as to displace seawater from the seawater ballast to compensate for increasing volume of the grey water in the third ballast bag, and means for filling the container with the seawater ballast to compensate for the extracting of the useful fluids, thereby providing a substantially constant volume of fluid ballast including the seawater, the useful fluids and the re-captured waste fluids, e) urging water from the first ballast bag by the pumping means for use in the boat, f) re-capturing used water as grey water and returning the re-captured grey water to the third ballast bag by the return means, g) urging fuel from the second ballast bag by the pumping means for use in the boat motor.

DETAILED DESCRIPTION OF EMBODIMENTS OF THE INVENTION

Figure 1:
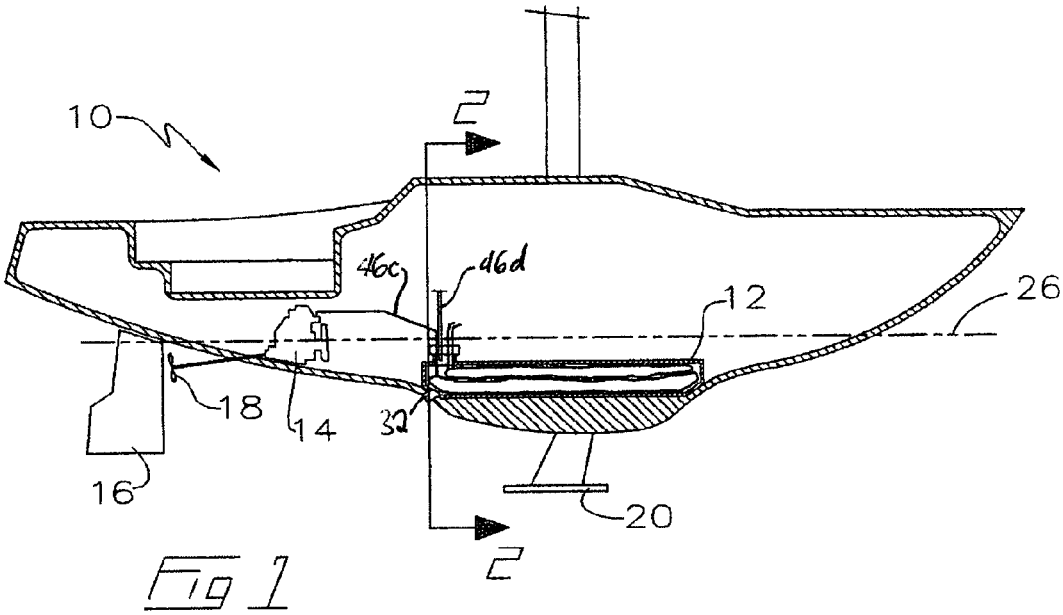
FIG. 1 is a sectional view of a boat equipped with the present invention.

FIG. 1 illustrates a boat 10 equipped with ballast tank 12, motor 14, rudder 16, propeller 18 and bilge keel 20. Similar to standard ballast tanks on many water vessels, tank 12 is situate in the lower regions of boat 10 along the keel or centreboard, below water line 26 so as to provide functional ballast weight and lower the centre of gravity of boat 10.

Figure 2:
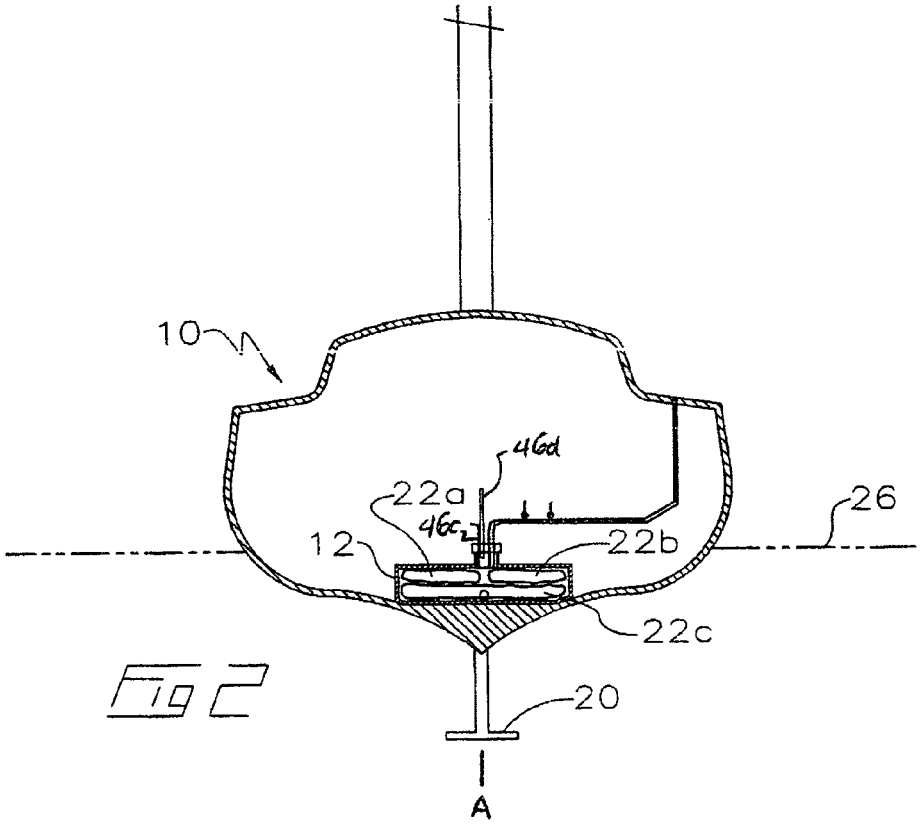
FIG. 2 is a sectional view invention along line 2—2 in FIG. 1.

As illustrated in FIG. 2, tank 12 contains a plurality of flexible bags for storing liquids. In the illustrated embodiment, not intended to be limiting, bag 22*a* holds fresh water, bag 22*b* holds grey water and bag 22*c* holds fuel such as diesel fuel for the boat motor. Fuel storage is thus moved from a higher centre of gravity elsewhere on boat 10 to a lower one within tank 12 where it becomes functional ballast weight, assisting stabilizing the vessel with less weight above the water line.

Figure 3:
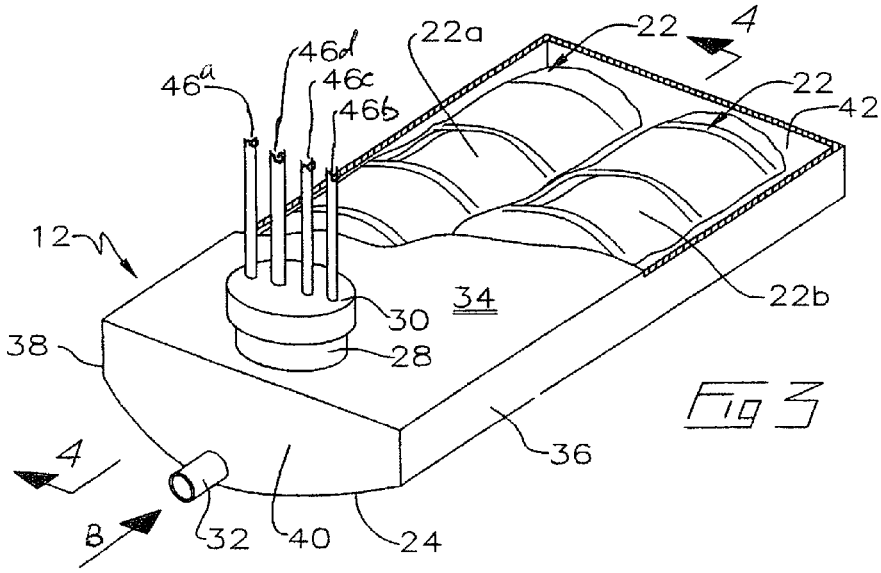
FIG. 3 is an isometric view of the present invention with its top cover partially cut away.
Figure 4:
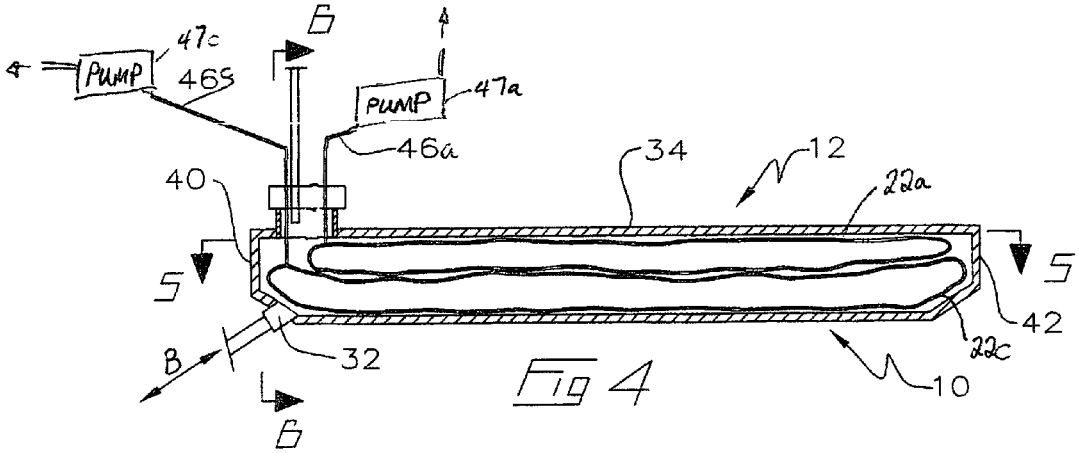
FIG. 4 is a sectional view along line 4—4 in FIG. 3.

As illustrated in FIG. 3, tanks 12 may include a rigid hollow container whose underside 24 may in some embodiments, not intended to be limiting, be curved to mirror the curvature of the hull of boat 10. In other embodiments, the underside may comprise a plurality of bevelled surfaces, as seen in FIG. 4. In the illustrated embodiment, tank 12 has a flat upper surface 34, parallel and opposite port and starboard sides 36 and 38 equidistant and parallel to the vertical plan of symmetry A of the hull. Tank 12 may also nave parallel and opposite stern and bow sides 40 and 42 respectively. Sides 36, 38, 40 and 42 are contiguous and may meet at right angles at the intersections thereof. An access such as hatch 28 having a hatch cap 30 is formed in or mounted to upper surface 34 of tank 12. A ballast intake pipe 32 is mounted so as to protrude from the base of stern side 40. Visible in FIG. 3 are two bags 22, which may in one embodiment be fresh water bag 22*a* and grey water bag 22*b*.

Bags 22 may be installed by inserting them through hatch 28, the size of which may vary with the size of tank 12. Hatch 28 need only be large enough to insert the deflated bags one at a time. Hatch cover 44 on hatch cap 30, may be made of clear plastic, such as acrylic or plexiglass, to facilitate a user viewing the internal status of the ballast system. Hatch cap 30 may in one embodiment screw down onto hatch 28 so as to provide a watertight seal on the hatch by, for example, the use of a rubber seal (not shown). Fluid hoses 46 enter through hatch cover 44 at the appropriate angle to suit each installation and lead to bags 22.

When boat 10 is on the water, seawater flows in direction B into tank 12 through intake pipe 32 to provide ballast weight. The ballast weight is complemented by the weight of the fluids contained within bags 22. Tank 12 is meant to remain full, so that as fuel from bag 22*c* is pumped out of tank 12 through hose 46*c* connected to bag 22*c*, sea water is drawn into tank 12 through intake pipe 32 to compensate for the lost volume of fuel. Similarly, fresh water may be pumped from bag 22*a* through hose 46*a* for use and, once used, pumped back into grey water bag 22*b* through hose 46*b*. The system may contain corresponding 12 volt electrically driven fluid pumps 47*a* and 47*c* to move fluid from ballast to the fluid's end use as needed. Air is allowed to vent through conduit 46*d*.

Figure 5:
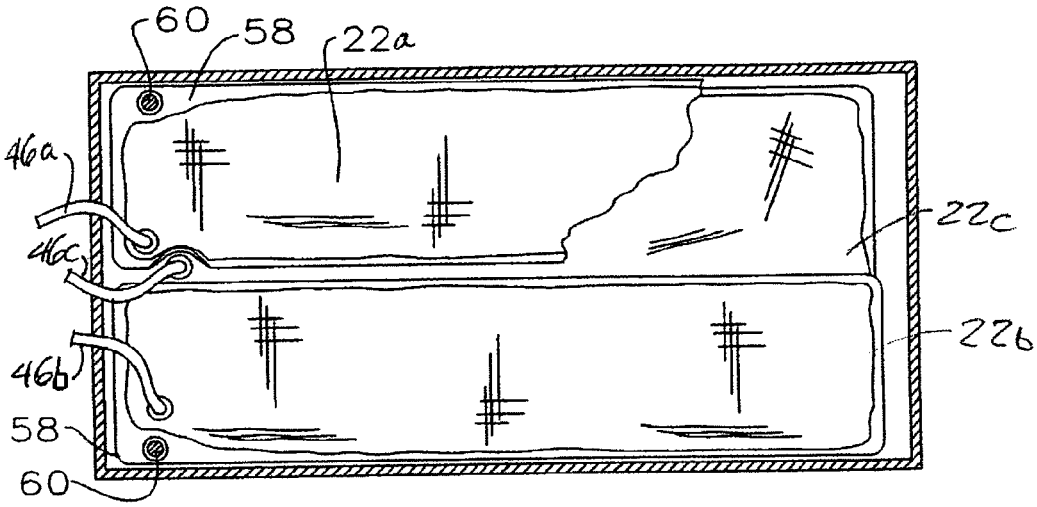
FIG. 5 is a horizontal sectional view along line 5—5 in FIG. 4.
Figure 6:
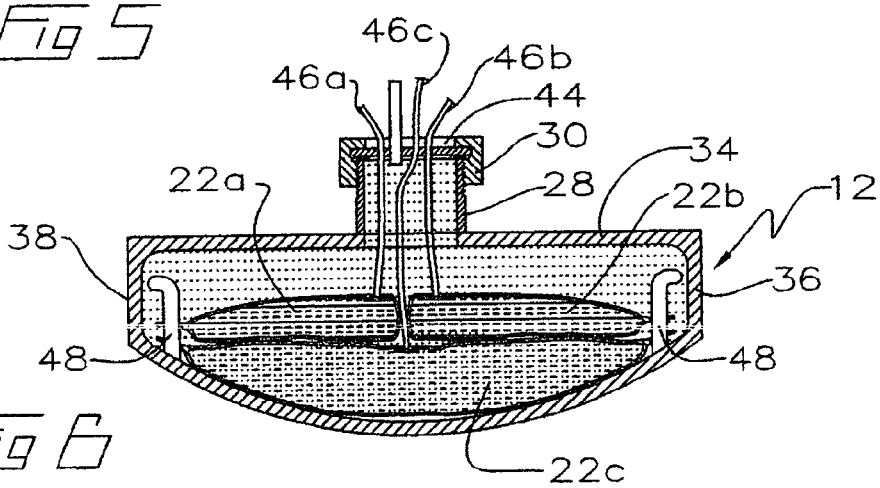
FIG. 6 is a vertical sectional view along line 6—6 in FIG. 4.

As illustrated in FIG. 5, bags 22 have a heavy perimeter flange 58 with at least one grommet 60 per bag. Grommets 60 are positioned on bags 22 such that once the bags are in place inside tank 12, grommets 60 may be placed over upstanding pins 48, as illustrated in FIG. 6, so as to keep bags 22 in place within tank 12. Pins 48 may be placed within tank 12 at the port and starboard sides of tank 12. In the embodiment illustrated in FIG. 6, bags 22*a* and 22*b* have one grommet each while fuel bag 22*c* is anchored by two grommets.

Figure 7:
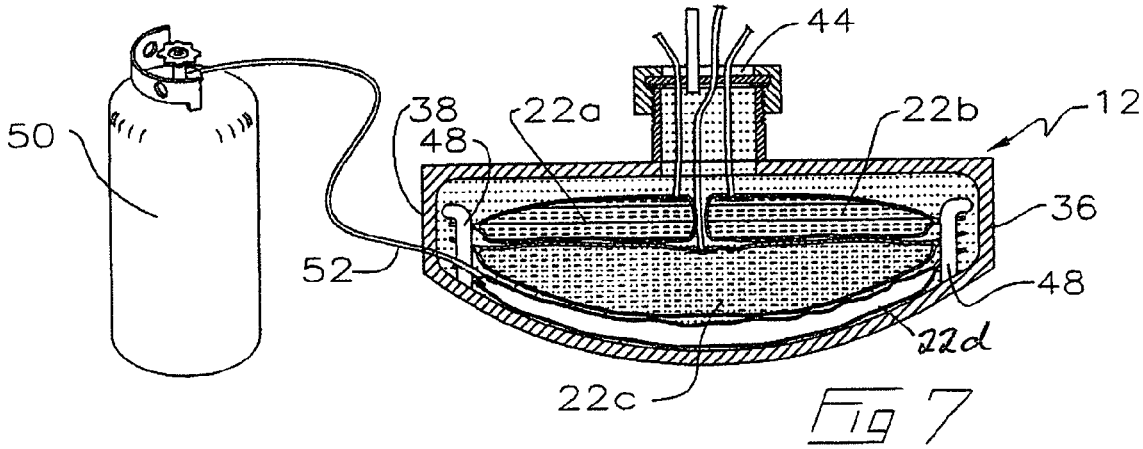
FIG. 7 is the vertical sectional view of FIG. 6 showing an inflatable bag connected to a compressed air cylinder.
Figure 8:
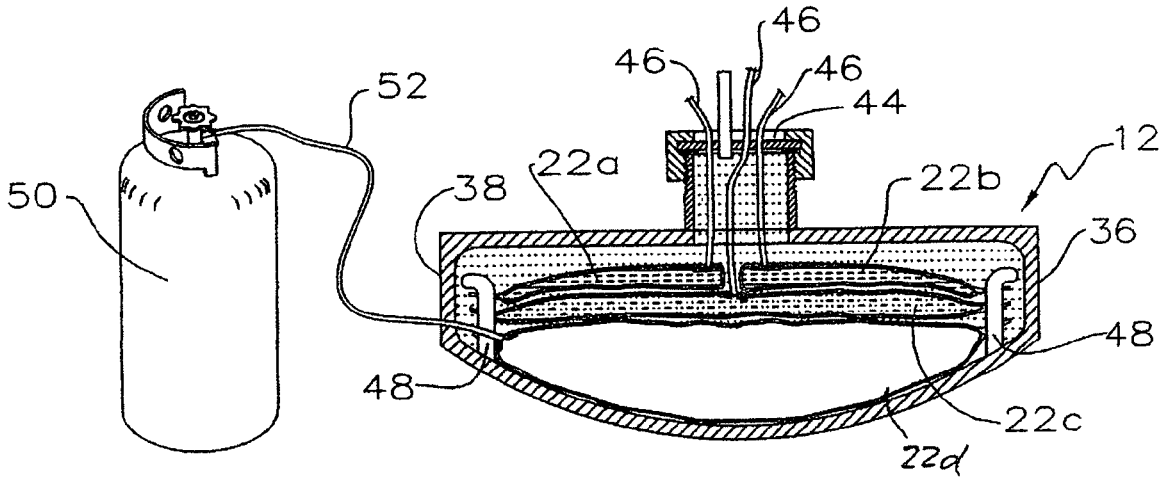
FIG. 8 is the view of FIG. 7 with the inflatable bag inflated.

In one embodiment, the system may also employ a pressurized air tank 50 attached by a hose 52 to bladder 22*d* inside tank 12 to add buoyancy to boat 10 as desired, and particularly in case of a hull rupture to add buoyancy for safety and salvage. Bladder 22*d* is shown deflated and inflated in FIGS. 7 and 8, respectively.

Figure 9:
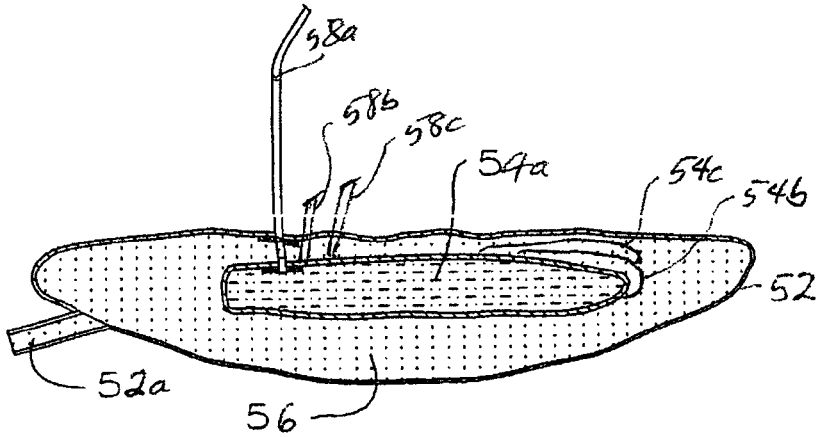
FIG. 9 is side view of an alternative embodiment of the bag system of the present invention.

In a further alternative embodiment, illustrated in FIG. 9, rigid tank 12 may be replaced with a flexible container 52 in which flexible fluid bags 54*a*, 54*b* and 54*c* may be mounted, nested, with the fluid bags inside the container. For example, fuel bag 54*a*, fresh water bag 54*b*, and grey water bag 54*c* may be mounted in container 52 and extracted via hoses 58*a*, 58*b* and 58*c* respectively, which may fill with seawater 56 drawn in through intake pipe 52*a*. This system provides for greater flexibility in ballast placement within the vessel, allowing placement in irregularly shaped areas in the hull.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. An apparatus for maintaining a fluid ballast in the hull of a boat comprising:

a container within the hull for holding seawater ballast, a plurality of flexible bags mounted in said container so that the volume of said plurality of flexible bags displaces a like volume of seawater ballast from said container so as to maintain a substantially constant volume of fluid ballast in said container, wherein said ballast bags are adapted for holding useful fluids including potable water in a first ballast bag of said plurality of flexible bags, motor fuel in a second ballast bag of said plurality of flexible bags and re-captured grey water in a third ballast bag of said plurality of flexible bags, pumping means for extracting said useful fluids from said first and second ballast bags for use in the boat, and return means for returning re-captured grey water re-captured from use in the boat to corresponding said third ballast bag, where said ballast bags are in fluid communication with said pumping means within the hull for extracting said useful fluids from corresponding said ballast bags and said return means for returning re-captured grey water to said corresponding said third ballast bag, a means for displacing said like volume of sea water from said container so as to displace seawater from said seawater ballast to compensate for increasing volume of said grey water in said third ballast bag, and means for filling said container with said seawater ballast to compensate for said extracting of said useful fluids, thereby providing a substantially constant volume of fluid ballast including said seawater, said useful fluids and said re-captured waste fluids.

2. The apparatus of claim 1 further comprising a bladder mounted in said container and wherein said pumping means includes a means for inflating said bladder with a gas.

3. The apparatus of claim 2 wherein said gas is air and said means for inflating is a pressurized gas canister.

4. The apparatus of claim 2 wherein when said bladder and said flexible bags are substantially full, said container is substantially full of said fuel, said fresh water, said grey water and said gas.

5. The apparatus of claim 1 wherein said container is rigid.

6. The apparatus of claim 1 wherein said container is flexible.

7. The apparatus of claim 1 wherein said flexible bags are mounted closely adjacent one another, nested within said container.

8. The apparatus of claim 1 wherein when said flexible bags are substantially full, said container is more than one-half full of said fuel, said fresh water and said grey water.

9. The apparatus of claim 1 wherein said means for displacing said like volume of seawater and said means for filling said container with said seawater is a hollow conduit in fluid communication between said container and an exterior of the hull for free flow of seawater along said conduit into and out of said container.

10. A method for maintaining a fluid ballast in the hull of a boat comprising the steps of:

a) providing a container within the hull for holding seawater ballast, b) providing a plurality of flexible bags mounted in said container so that the volume of said plurality of flexible bags displaces a like volume of seawater ballast from said container so as to maintain a substantially constant volume of fluid ballast in said container, wherein said ballast bags are adapted for holding useful fluids including providing for holding potable water in a first ballast bag of said plurality of flexible bags, motor fuel in a second ballast bag of said plurality of flexible bags, and re-captured grey water in a third ballast bag of said plurality of flexible bags, c) providing pumping means for extracting said useful fluids from said first and second ballast bags for use in the boat, and return means for returning re-captured grey water re-captured from use in the boat to corresponding said third ballast bag, wherein said ballast bags are in fluid communication with said pumping means within the hull for extracting said useful fluids from corresponding said ballast bags and said return means for returning re-captured grey water to said corresponding said third ballast bag, d) providing a means for displacing said like volume of sea water from said container so as to displace seawater from said seawater ballast to compensate for increasing volume of said grey water in said third ballast bag, and means for filling said container with said seawater ballast to compensate for said extracting of said useful fluids, thereby providing a substantially constant volume of fluid ballast including said seawater, said useful fluids and said re-captured waste fluids, e) urging water from said first ballast bag by said pumping means for use in the boat, f) re-capturing used water as grey water and returning said re-captured grey water to said third ballast bag by said return means, g) urging fuel from said second ballast bag by said pumping means for use in the boat motor.

11. The method of claim 10 further comprising the step of providing a bladder mounted in said container and wherein said pumping means includes a means for inflating said bladder with a gas.

12. The method of claim 11 further comprising providing a pressurized gas canister as said means for inflating said bladder.

13. The method of claim 10 further comprising the step of mounting said flexible bags closely adjacent one another, nested within said container.

* * * * *